US007312578B2

(12) United States Patent
Lee et al.

(10) Patent No.: US 7,312,578 B2
(45) Date of Patent: Dec. 25, 2007

(54) PLASMA LIGHTING BULB WITH METAL PROVIDED IN GROOVES FORMED ON SURFACE THEREOF

(75) Inventors: Seung Min Lee, Yongin-si (KR); Byoung Chul Min, Seoul (KR); Young Hwan Choi, Seoul (KR)

(73) Assignee: LG Electronics Inc., Seoul (KR)

( * ) Notice: Subject to any disclaimer, the term of this patent is extended or adjusted under 35 U.S.C. 154(b) by 108 days.

(21) Appl. No.: 10/808,777

(22) Filed: Mar. 24, 2004

(65) Prior Publication Data

US 2004/0189197 A1 Sep. 30, 2004

(30) Foreign Application Priority Data

Mar. 24, 2003 (KR) ..... 10-2003-0018273

(51) Int. Cl.
*H01J 17/16* (2006.01)
*H01J 61/30* (2006.01)

(52) U.S. Cl. ..... 313/634; 313/582; 313/238

(58) Field of Classification Search ..... 313/582, 313/634, 238, 161; 362/260, 263; 315/248
See application file for complete search history.

(56) References Cited

U.S. PATENT DOCUMENTS

| | | | | |
|---|---|---|---|---|
| 4,568,859 | A * | 2/1986 | Houkes et al. | 315/248 |
| 4,645,967 | A * | 2/1987 | Bouman et al. | 313/248 |
| 4,704,562 | A * | 11/1987 | Postma et al. | 315/248 |
| 5,397,966 | A * | 3/1995 | Vrionis et al. | 315/248 |
| 6,023,130 | A * | 2/2000 | Sakasegawa et al. | 313/582 |
| 6,747,409 | B1 * | 6/2004 | Han et al. | 313/582 |
| 6,752,884 | B2 * | 6/2004 | Min | 148/518 |

* cited by examiner

*Primary Examiner*—Mariceli Santiago
*Assistant Examiner*—Kevin Quarterman
(74) *Attorney, Agent, or Firm*—Lee, Hong, Degerman, Kang & Schmadeka

(57) ABSTRACT

A plasma lighting bulb is disclosed. The plasma lighting bulb includes a bulb emitting light, being formed of a transparent material, and having a plurality of grooves having a predetermined depth formed on a surface of the bulb, and a metal formed in the grooves, wherein a cross-section of the grooves is formed of one of a semicircular shape, a V-shape, and a polygonal shape.

13 Claims, 2 Drawing Sheets

PLASMA LIGHTING BULB WITH METAL PROVIDED IN GROOVES FORMED ON SURFACE THEREOF

CROSS-REFERENCE TO RELATED APPLICATIONS

This application claims the benefit of Korean Application No. P2003-018273, filed on Mar. 24, 2003, which is hereby incorporated by reference as if fully set forth herein.

BACKGROUND OF THE INVENTION

1. Field of the Invention

The present invention relates to a plasma lighting bulb, and more particularly, to a plasma lighting bulb blocking electromagnetic waves. Although the present invention is suitable for a wide scope of applications, it is particularly suitable for providing a plasma lighting bulb that can efficiently block electromagnetic waves.

2. Discussion of the Related Art

A plasma lighting system is a lighting device formed by sealing gas and a lighting material within a vacuum bulb and, then, forming plasma by using microwaves, thereby producing a light closest to natural light.

Since lighting occurs by the microwaves, in the plasma lighting system, high-frequency electromagnetic waves must be applied to the lighting bulb.

However, such electromagnetic waves have the tendency to be spatially diffused, thereby disturbing the peripheral devices. Accordingly, a plasma lighting system capable of blocking such electromagnetic waves is increasingly in demand.

SUMMARY OF THE INVENTION

Accordingly, the present invention is directed to a plasma lighting bulb that substantially obviates one or more problems due to limitations and disadvantages of the related art.

An object of the present invention is to provide a plasma lighting bulb that can block electromagnetic waves.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a plasma lighting bulb includes a bulb emitting light, being formed of a transparent material, and having a plurality of grooves having a predetermined depth formed on a surface of the bulb, and a metal formed in the grooves.

Herein, the transparent material includes one of glass and plastic, and the surface of the bulb includes a plurality of patterns having one of a circular shape, a triangular shape, and a polygonal shape due to an alignment of the grooves.

Also, the grooves are formed on at least one of an outer surface and an inner surface of the bulb, the cross-section of which is formed of one of a semicircular shape, a V-shape, and a polygonal shape.

The metal can be formed along the grooves in the form of a wire, or the metal is filled within the grooves.

Moreover, the metal includes one of copper (Cu), aluminum (Al), and silver (Ag)-coated copper (Cu).

In another aspect of the present invention, a plasma lighting bulb includes a bulb emitting light, being formed of a transparent material, and having a plurality of patterns formed on a surface of the bulb due to an alignment of a plurality of grooves having a predetermined depth, and a metal wire formed in the grooves forming the patterns.

In a further aspect of the present invention, a plasma lighting bulb includes a bulb emitting light, being formed of a transparent material, and having a plurality of hexagonal patterns formed on an outer surface of the bulb due to an alignment of a plurality of grooves having a predetermined depth, and a metal wire blocking electromagnetic waves formed in the grooves forming the patterns.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiments of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings. Wherever possible, the same reference numbers will be used throughout the drawings to refer to the same or like parts.

In the present invention, a metal is used to block the electromagnetic waves generating from the lighting bulb. Herein, the metal for blocking the electromagnetic waves should satisfy the conditions of having a high blocking efficiency, a small surface area for preventing the light from being blocked, and a long durability.

In order to meet with the above-described conditions, a groove is formed on the surface of the plasma lighting bulb according to the present invention, the groove having a metal formed therein.

Figure 1:
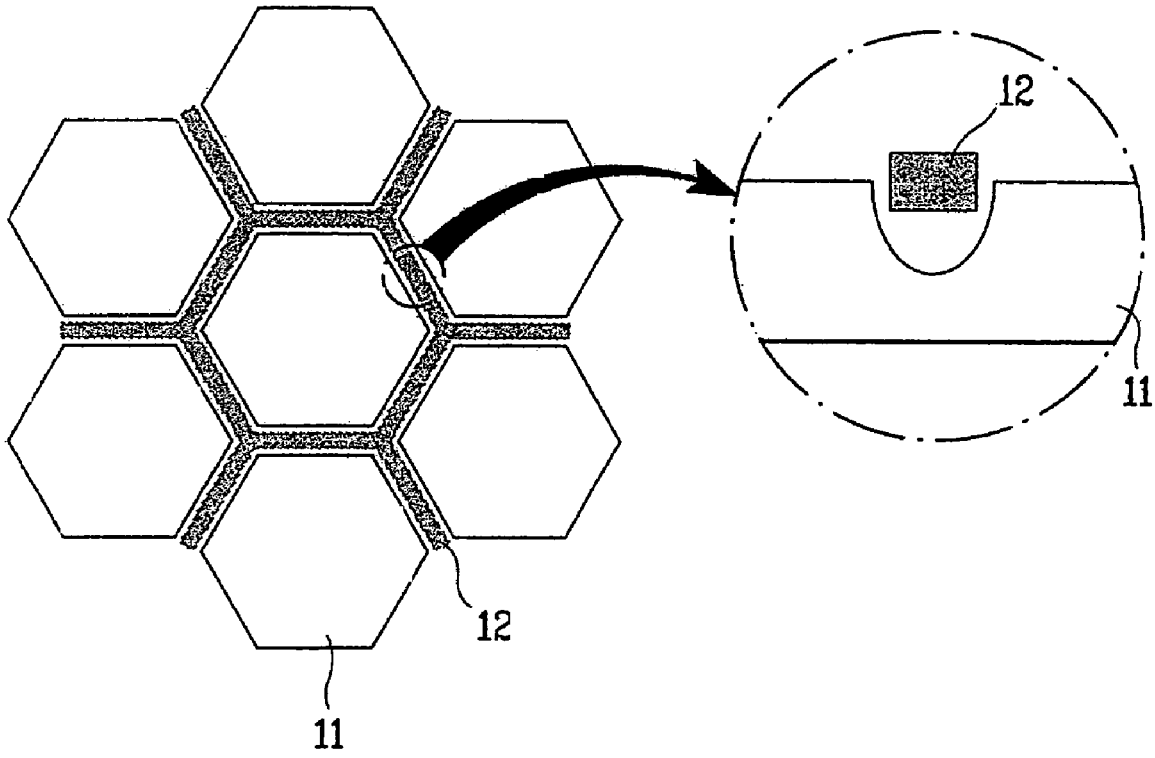
FIG. 1 illustrates a plane view and an expanded cross-sectional view showing a surface of a plasma lighting bulb according to the present invention.

FIG. 1 illustrates a plane view and an expanded cross-sectional view showing a surface of a plasma lighting bulb according to the present invention.

Referring to FIG. 1, the plasma lighting bulb according to the present invention includes a bulb 11 generating light, and a metal wire 12 formed in the groove area of the bulb 11. Herein, the bulb 11 is formed of a transparent material, whereby a plurality of grooves having a predetermined depth is formed on the surface thereof.

In addition, the transparent bulb 11 can also be formed of either glass or plastic.

A plurality of patterns is formed on the surface of the bulb 11. Herein, due to the alignment of the grooves, the patterns are formed in one of a circular shape, a triangular shape, and a polygonal shape. Also, the grooves formed on a surface of the bulb 11, can be formed on at least one of the inner surface and the outer surface of the bulb 11.

In the present invention, due to the alignment of the grooves having a predetermined depth, a plurality of hexagonal patterns is formed on the outer surface of the bulb 11, as shown in FIG. 1.

At this point, the cross-section of the groove can be formed in one of a semicircular shape, a V-shape, and a polygonal shape.

The metal wire 12 in the groove area is formed along the groove. Also, the groove can be filled with a metal, instead of forming the metal wire therein. The metal wire 12 or the metal filling the groove can be one of copper (Cu), aluminum (Al), and silver (Ag)-coated copper (Cu).

Since the metal wire 12 is aligned in a honeycomb-like hexagonal shape, the present invention can provide an excellent blocking efficiency of the electromagnetic waves. However, since the metal wire 12 blocking the electromagnetic waves can also block emitted light rays, a groove having a predetermined depth is formed so as to allow a larger amount of light rays to be emitted.

Figure 2:
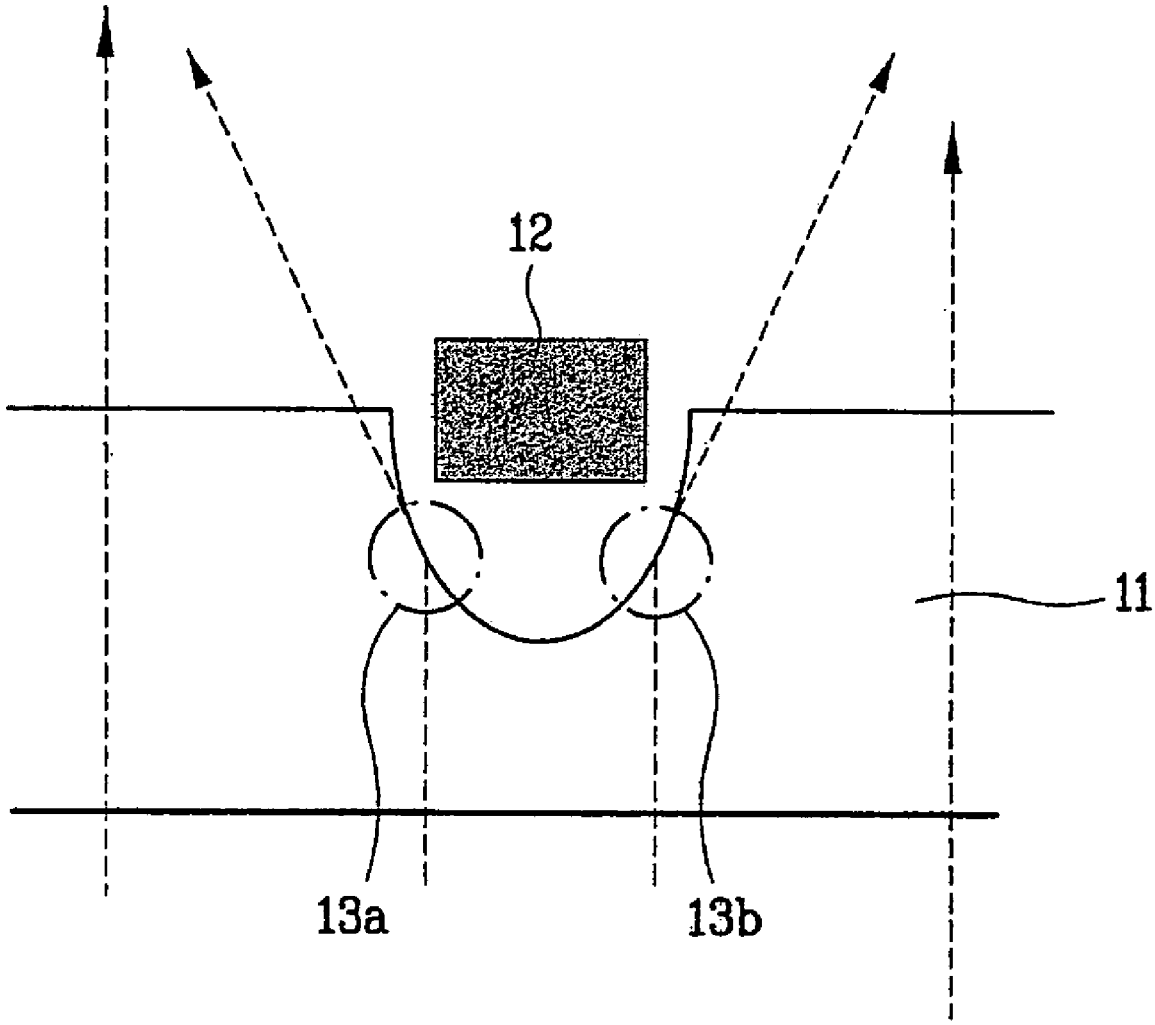
FIG. 2 illustrates a refraction of a light generating from the plasma lighting bulb according to the present invention.

FIG. 2 illustrates a refraction of a light generating from the plasma lighting bulb according to the present invention.

Referring to FIG. 2, the cross-section of the groove is formed in a semicircular shape. Accordingly, the light rays emitted towards the metal wire 12 are refracted by the semicircular groove. And so, the refracted light rays 13*a* and 13*b* are emitted to the outside of the bulb 11. Therefore, although the metal wire 12 is formed on the surface of the bulb 11, the luminance of the bulb 11 is not reduced.

Moreover, in the plasma lighting bulb according to the present invention, the surface area of the metal wire 12 can be increased, while the luminance of the bulb 11 is maintained, thereby providing an excellent blocking efficiency of electromagnetic waves.

As described above, the plasma lighting bulb according to the present invention has the following advantages.

The metal wire is aligned in a honeycomb-like hexagonal shape on the surface of the bulb, thereby increasing the blocking efficiency of electromagnetic waves.

In addition, since the metal wire forms a groove in the bulb area, the metal wire being aligned therein, thereby enhancing the transmissivity of the light rays.

Finally, since the surface area of the metal wire can be increased while maintaining the luminance of the bulb, an excellent blocking efficiency of electromagnetic waves can be provided.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. A plasma lighting bulb, comprising:

a bulb emitting light, being formed of a transparent material, and having a plurality of hexagonal patterns formed on an outer surface of the bulb due to an alignment of a plurality of grooves having a predetermined depth; and a metal wire blocking electromagnetic waves formed in the grooves forming the patterns.

2. The lighting bulb according to claim 1, wherein the transparent material includes one of glass and plastic.

3. The lighting bulb according to claim 1, wherein a cross-section of the grooves forming the hexagonal patterns is formed of one of a semicircular shape, a V-shape, and a polygonal shape.

4. The lighting bulb according to claim 1, wherein the metal wire is formed of one of copper (Cu), aluminum (Al), and silver (Ag)-coated copper (Cu).

5. A plasma lighting bulb comprising:

a plurality of grooves groves formed on at least an inner or an outer surface of the bulb; and metal formed in the plurality of grooves for blocking electromagnetic waves, wherein the plurality of grooves forms a plurality of polygon patterns.

6. The plasma lighting bulb of claim 5, wherein the bulb is formed of a transparent material.

7. The plasma lighting bulb of claims 6, wherein the transparent material is glass.

8. The plasma lighting bulb of claim 6, wherein the transparent material is plastic.

9. The plasma lighting bulb of claim 5, wherein the cross-section of the groves is a semi-circular shape, a V-shape, or a polygonal shape.

10. The plasma lighting bulb of claim 5, wherein the metal in the groves is formed of wire.

11. The plasma lighting bulb of claim 5, wherein the metal is filled within the grooves.

12. The plasma lighting bulb of claim 5, wherein the metal includes one of copper (Cu), aluminum (Al), and silver (Ag).

13. The plasma lighting bulb of claim 5, wherein the polygons are one of triangles and hexagons.

* * * * *